US005950258A

United States Patent [19]

Deyne et al.

[11] Patent Number: 5,950,258

[45] Date of Patent: Sep. 14, 1999

[54] PORTABLE LIFTING AID FOR THE HANDICAPPED AND OTHERS

[76] Inventors: Gustave De Deyne, 119 Firestone, Diamond Head, Hot Springs, Ark. 71913; Jerome J. Hruska, 2325 N. State Hwy. 265, Branson, Mo. 65616

[21] Appl. No.: 08/929,454

[22] Filed: Sep. 15, 1997

Related U.S. Application Data

[63] Continuation-in-part of application No. 29/051,110, Mar. 4, 1996, Pat. No. Des. 384,469.

[51] Int. Cl.[6] ..... A61G 7/08; A45B 3/00

[52] U.S. Cl. ..... 5/81.1 R; 135/66

[58] Field of Search ..... 5/81.1, 83.1, 84.1, 5/86.1, 87.1; 297/5; 135/65, 66, 67, 72

[56] References Cited

U.S. PATENT DOCUMENTS

| | | | |
|---|---|---|---|
| D. 186,506 | 11/1959 | Rosenberg . | |
| D. 352,590 | 11/1994 | Hodges . | |
| D. 355,293 | 2/1995 | Parker . | |
| D. 364,024 | 11/1995 | O'Keefe et al. . | |
| D. 384,468 | 9/1997 | Tobias . | |
| 785,855 | 3/1905 | Camp . | |
| 4,435,863 | 3/1984 | Lerich | 5/81.1 R |
| 4,918,771 | 4/1990 | James | 5/81.1 R |
| 5,137,102 | 8/1992 | Houston, Sr. et al. | 5/81.1 R |
| 5,189,741 | 3/1993 | Beardmore | 5/81.1 R |
| 5,257,425 | 11/1993 | Shinabarger . | |
| 5,347,666 | 9/1994 | Kippes . | |
| 5,411,044 | 5/1995 | Andolfi | 135/66 |
| 5,461,736 | 10/1995 | Carpenter et al. . | |
| 5,662,131 | 9/1997 | Scarborough et al. . | |
| 5,692,253 | 12/1997 | Keijser et al. . | |

*Primary Examiner*—Terry Lee Melius
*Assistant Examiner*—James Hewitt

[57] ABSTRACT

An upright stand provides lifting assistance to the elderly, the handicapped or the like. It is readily transportable and stowable. The reversible stand may access a variety of furniture items, and it may be successfully employed with sofas, love seats, commodes, chairs, beds, benches or the like. The stand comprises a rigid planar base placed adjacent the user upon the floor or carpet. A specially configured, angled, tower removably coupled to the base supports a handle that is grasped by a user to rise to a standing position. A special knee support on the tower is provided for leg support. For certain patients (i.e., severely crippled or partially paralyzed) it is recommended that the knee support be contacted by the users knees while rising. While simultaneously pulling on the handle a user can deflect his center of gravity forwardly. Because of leverage realized with our design and the advantageous shift to the users center of gravity, pulling forces that must be exerted by the user are reduced approximately 80%. Optional wheels can convert the stand to a walker or cherry picker configuration.

20 Claims, 6 Drawing Sheets

PORTABLE LIFTING AID FOR THE HANDICAPPED AND OTHERS

CROSS REFERENCE TO RELATED APPLICATION

This application is a Continuation in Part of a previously filed and currently pending United States Design Patent application Ser. No.: 29/051,118; Filing Date: Mar. 4, 1996; Group Art Unit: 2901; Examiner R. Taylor; Inventor Gustave De Deyne; and entitled: PORTABLE LIFTING AD FOR THE: HANDICAPPED.

BACKGROUND OF THE INVENTION

I. Field of the Invention

This invention relates generally to apparatus for assisting handicapped individuals, medical patients and the like. More particularly, the present invention relates to a portable lifting stand that readily enables users to rise from a seated to a standing position.

II. Description of the Prior Art

Many simple lifting devices for handicapped or crippled individuals are known in the art. A variety of devices may comprise a lower, planar base for placement on a floor or carpet. Such devices may support an upwardly projecting tower structure grasped by a user for lifting or rising. However, all known prior art lifting aid devices may be inconvenient and uncomfortable to use. Because of the conventional geometry or design characteristic of known prior art devices, excessive lifting or pulling forces must often be exerted by the user. We have sought to maximize leverage and user leg support to minimize the pulling forces needed to rise. Moreover a user must often grasp the tower portion while seated awkwardly. The handle must therefore be positioned conveniently relative to the user. Therefore an acceptable device must be adaptable for use in many different situations to present an accessible lift.

SUMMARY OF THE INVENTION

We have designed and tested a convenient, easily transportable stand that makes it easier for a user to rise or stand. The stand is ideal for handicapped individuals, various medical patients, the elderly and the like. It is reversible to accommodate a variety of typical real world situations. It may be successfully used to rise from a sofa, a bed, common chairs, commodes or the like. It provides a dependable and comfortable support for the users feet and knees to amplify convenience and comfort. Through the structure disclosed it minimizes the effort required to rise.

Our improved stand preferably comprises a rigid planar base that supports the apparatus upon the floor or carpet. An angled, rigid tower is removably coupled to the base by suitable brackets. The tower supports a suitable handle that is grasped by a user to pull himself while rising to a standing position. While using the stand the users knees may contact a special knee support on the tower for leg support. This can be ideal for the disabled or paralyzed patient or user. The knee support is contacted by the knees in front of the body while rising. The user is able to lean forward prior to exerting a pulling force, in effect changing his or her center of gravity. In other words, while simultaneously pulling on the handle a user can deflect his center of gravity forwardly. Because of the leverage and center of gravity changes realized with our design, the pulling forces applied by a patient who properly uses the unit are reduced approximately 80%.

In the best mode the tower is slightly offset from the center of the base. The tower preferably comprises three segments. The lowest side segments extend upwardly from the base at an acute angle. Intermediate tower portions are substantially perpendicular to the base, so that the knee support that extends between these portions is projected towards the front of the frame in a position facing the user. The uppermost tower frame portions angle away from the knee support towards the rear of the base at an obtuse angle.

Thus a basic object of our invention is to provide an assistance device for the handicapped and other medical patients or individuals that aids them is standing.

A similar object is to provide a helpful lifting stand that enables users to stand up from a bath tub, a toilet, conventional chairs, beds or the like.

A fundamental object of our invention is to provide a lifting stand of the character described that comfortably enhances user leverage. It is a feature of our invention that a strategically placed knee support provides substantial extra leg support that makes it much easier to safely rise and remain standing thereafter.

Thus a related object is to provide a stand of the character described that enables users, such as those paralyzed on one side from strokes, to rise with only the strength of one arm. It is a feature of the invention that the easy-to-use handle cooperates with the knee support to readily allow rising.

A related object is to provide a stand of the character described that helps prevent patients from losing their balance and falling.

Another object is to provide a stand of the character described that easily transforms to a walker or cherry picker. It is a feature of our invention that optional wheels may be mounted to the base rails to establish the transformation.

A related object of our invention is to provide a stand of the character described that is reversible. It is a feature of our invention that patients using the device can reverse it and modify the units' clearance. In this manner they can rise from chairs that extend all the way to the floor that might otherwise block the stand.

Another important object of our invention is to provide a stand to which trays or the like can easily be attached to hold food, medicine, oxygen units, or the like.

Another important object of our invention is to provide a stand of the character described that is easily shipped or stowed. It is a feature of our invention that the preferred stand can be quickly disassembled to assume a reduced volume configuration.

Another important object of our invention is to provide a stand of the character described that is easily assembled or reassembled by the user.

Another object is to provide a stand of the character described that is very safe. Important features include anti-slip surfaces for the feet and knee.

A related object of our invention is to provide a stand that is comfortable to sensitive, bare feet.

Yet another object of our invention is to prevent sensitive skin from tearing.

Another important object of our invention is to prevent feet from slipping through the unit. An important feature is that a foot guard is strategically placed upon the stand base.

A still further object is to support toes and knees while standing.

Yet another object is to provide a stand of the character described whose style and color unobtrusively blend in with the decor in the home or hospital.

Another object of our invention is to provide a portable stand for helping handicapped or injured individuals that can be quickly folded for convenient stowage in the trunk of a automobile.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
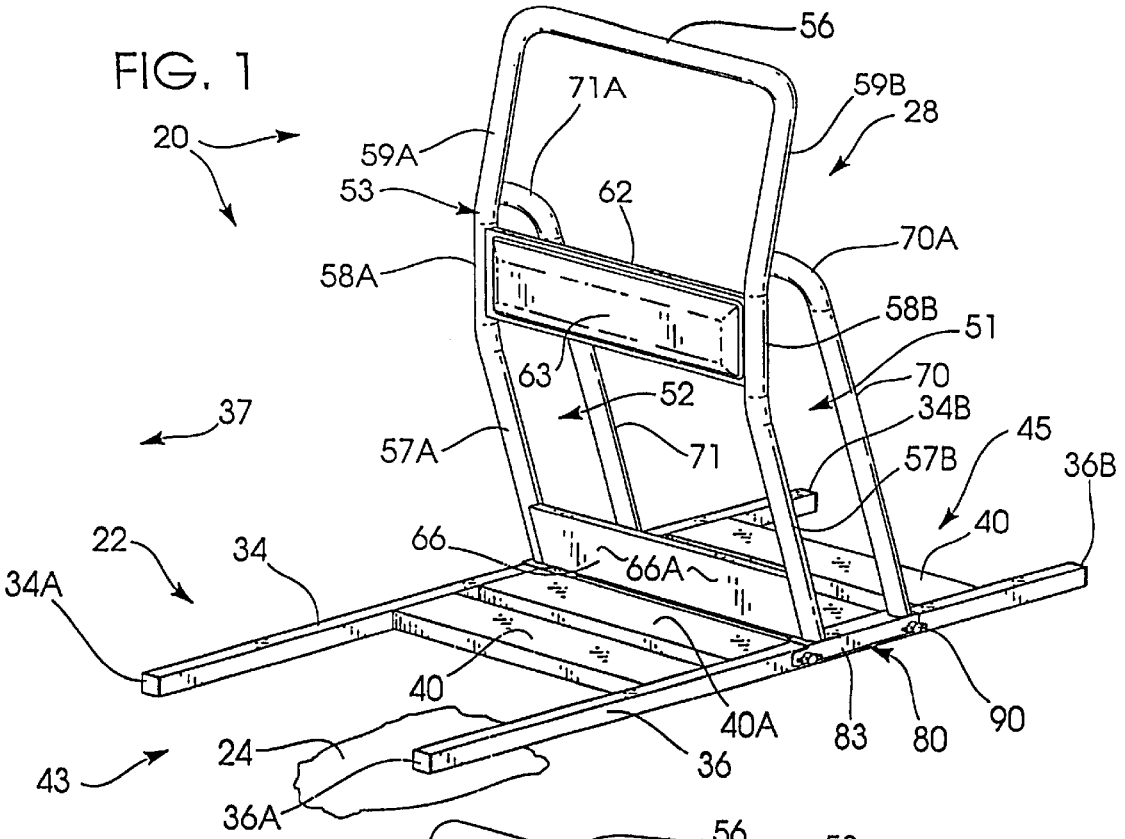
FIG. 1 is a partially fragmentary, frontal isometric view of our new stand.
Figure 2:
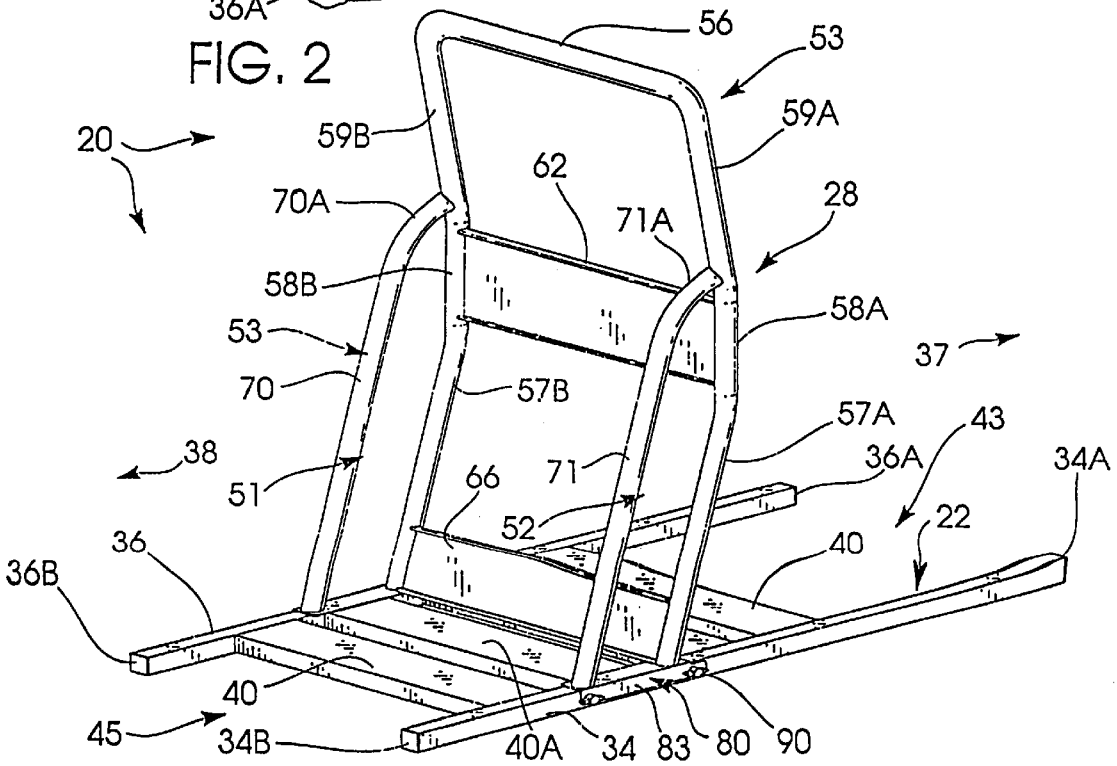
FIG. 2 is a rear isometric view thereof.

With reference now to the appended drawings, our improved stand for handicapped individuals has been generally designated by the reference numeral 20. As best seen in FIGS. 1–4, stand 20 preferably comprises a generally planar base 22 adapted to be disposed upon a supporting surface 24. Ordinarily the surface 24 will comprise the floor or carpet. It is preferred that the base be configured for as low a profile as possible to enhance the ease and comfort with which a user can mount or dismount the stand 20.

An upright, rigid tower generally designated by the reference numeral 28 extends vertically from base 22 for grasping by a user 30 (FIGS. 5–9). As described hereinafter, a user 30 may grasp the tower 28 and pull themselves upwardly to a rising position as illustrated generally in FIGS. 5–7. During the rising process the knees of the user will contact the tower as explained hereinafter.

Base 22 is generally planar and rests on surface 24. Preferably base 22 comprises a pair of elongated, parallel rails 34, 36. These rigid rails extend generally from the front 37 of the stand to the rear 38 thereof. In its preferred form base 22 is reinforced by a plurality of generally rectangular, regularly spaced apart foot plates 40 that extend transversely between the rails 34, 36. Preferably the exposed, outer surfaces of each foot plate 40A are treated with anti-frictional coatings or are otherwise provided with non-slip surfaces.

The base rails and the foot plates cooperate to define a stable horizontal platform that rests upon supporting surface 24 previously discussed. At the front 37 of the stand there is a void region 43 (FIG. 4) formed between the front 36A and front 34A of the base rails. With the stand 20 oriented in the normal orientation (i.e., FIGS. 4, 8) region 43 provides clearance for the feet of the user. This void provides clearance so the stand fits around items such as toilets and chairs, enabling the user to draw the stand closer for proper use. A smaller clearance region 45 (FIG. 2) at the rear 38 of the stand 20 is defined between the rear ends 36B and 34B of the base rails.

Figure 4:
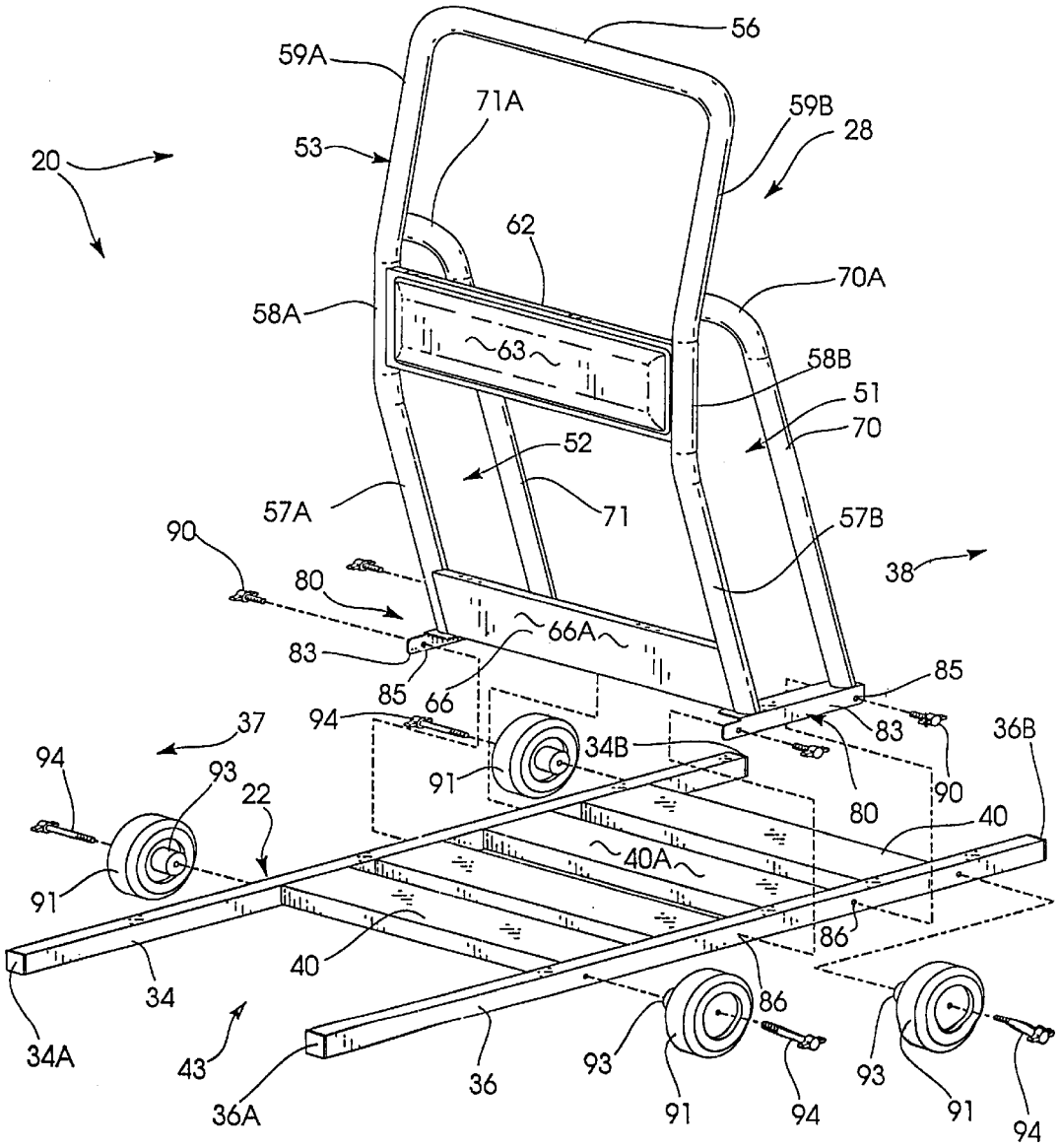
FIG. 4 is an enlarged, partially exploded view thereof showing the optional walker wheels that may be fitted to the base.

The rigid tower 28 extends upwardly from the base. Tower 28 comprises a pair of spaced apart sides generally designated by the reference numerals 51 and 52 (FIG. 4). Portions of these sides are formed by the upright, generally rectangular frame 53 that projects vertically from the base 22. Frame 53 terminates at its top in an elongated, rigid handle 56 adapted to be grasped by a user. Handle 56 also prevents a user from "pitching forward" if one's balance is lost while rising. Frame 53 comprises a pair of spaced apart, lower side portions 57A and 57B that project away from the base at an acute angle to be described hereinafter. The lower frame side portions 57A and 57B are integral with intermediate side frame portions 58A and 58B respectively. These are respectively integral with the upper side frame portions 59A and 59B that support handle 56. In the best mode the intermediate frame side portions 58A and 58B are oriented substantially vertically with respect to the base 22.

Preferably a rigid, generally rectangular knee support 62 extends between tower frame intermediate portions 58A and 58B. Knee support 62 is thus aimed at the front 37 of the stand 20 when the stand is in normal use. As seen in FIGS. 5–9, the knee support 62 may be contacted by the knees of a user when rising. Preferably the knee support comprises a soft pad or fixable surface 63 to comfort the knees of the user when contacting the stand. This strategically placed knee support 62 provides substantial extra leg support that makes it much easier for the severely crippled or paralyzed to safely rise and remain standing thereafter, especially if the user is crippled or disabled. It may be contacted by the user's knees directly in front of the body to aid a crippled patient, for example, in rising. The knee support also provides a barrier to keep a user from accidentally falling through the stand.

While simultaneously grasping and pulling on the handle 56 with his or her hands a user can easily move the body's center of weight forward. With the preferred design benefits in leverage and a center of gravity shift are realized by, a user. This reduces the amount of pulling force that must be exerted by the users arms. If a user bends the chin towards his thumbs before pulling on the handle, the required pulling force is reduced approximately 80%.

Preferably the tower 28 comprises a pair of rigid, reinforcements 70 and 71 that extend upwardly from the base and attach to buttress frame 53. For a major portion of their length the reinforcements 70, 71 are parallel with the lower frame side portions 57A and 57B. Each reinforcement 70, 71 preferably terminates in an upper, arcuate portion 71A or 70A respectively that is welded to the top rear of the frame 53. These curved portions 70A, 71A form an alternative gripping point or handle when the stand is reversed. In other words when the stand is reversed as in FIG. 9, the user could grasp arcuate portions 70A or 71 A.

It is preferred that the users feet be prevented from slipping under the tower. A lower rectangular foot guard 66 extends beneath the knee guard 62 and is fastened to the frame lower portions 57A and 57B. Guard 66 prevents the feet of the user from sliding under the knee support 62. Preferably it is coated with a suitable non-skid coating.

Figure 3:
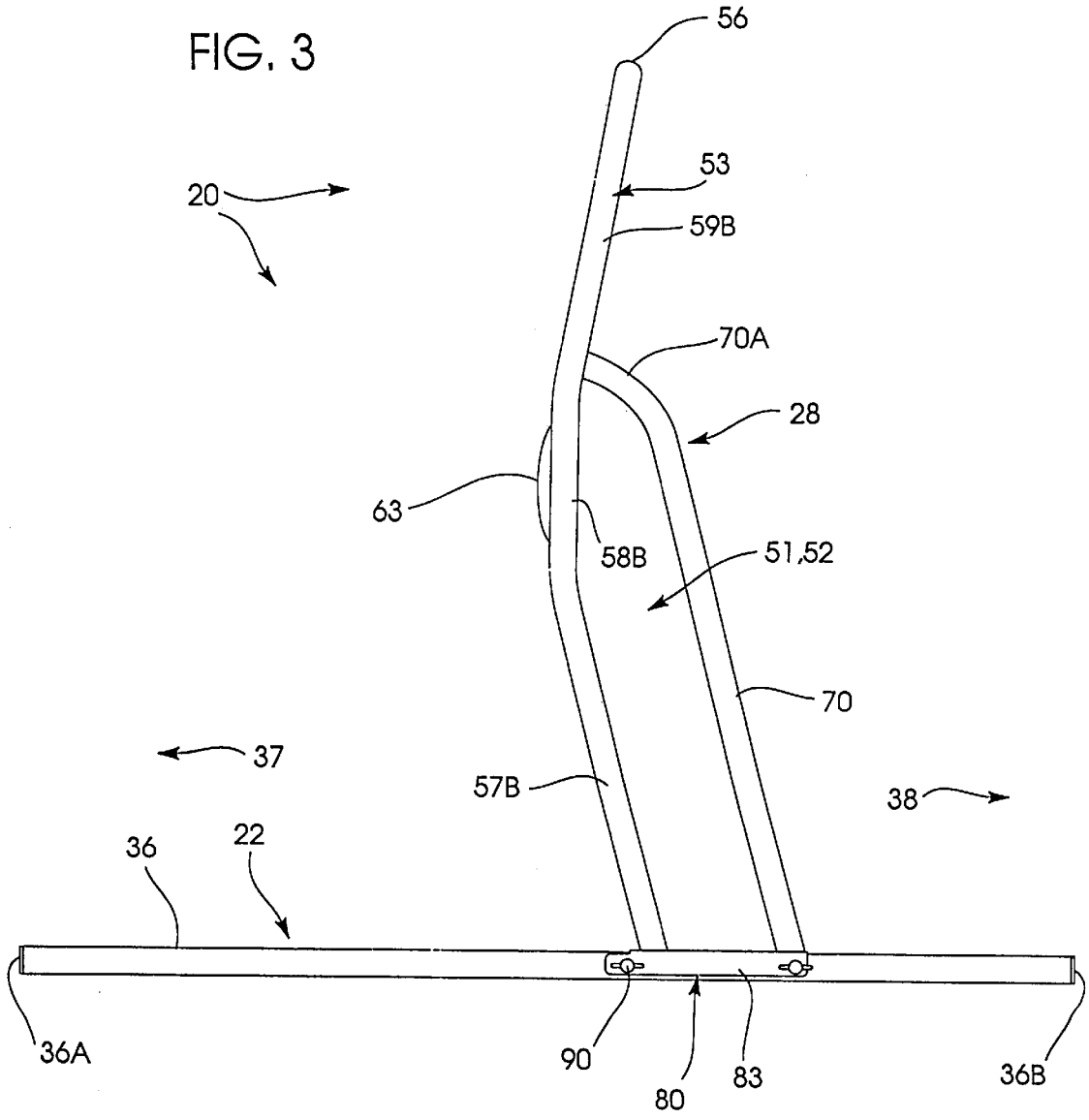
FIG. 3 is side elevational view thereof, with the opposite side comprising a mirror image.

Preferably the tower is removably mounted to the base 22 with a bracket 80. As best seen in FIG. 3, bracket 80 is mounted off center, shifted generally to tie right (as viewed in FIG. 3), of the center 81 of the stand. Bracket 80 extends beneath the lower portions 57B, 57A and the lowermost portions of the reinforcements 70 and 71. Each bracket 80 is of generally L-shaped cross sectioned, and includes a downwardly depending flange portion 83 (FIG. 4) equipped with mounting orifice 85. When placed properly upon the rails 34 or 36 orifices 85 register with rail orifices 86 . At this time the bolt fasteners 90 can be manually installed. They are inserted into and threadably received within orifices 86 to assemble the apparatus, captivating the brackets 80 upon the base.

As seen in FIG. 4, the stand 20 may be transformed to a walker or a "cherry picker" by adding optional wheels. For example, wheels 91 may be mounted to the base rails 34 or 36 with offset sleeve bearings 93 and suitable fasteners 94. One person may easily use the device as a walker in this mode. With the aid of an additional person or helper who would push the wheeled stand to a new location, the unit functions as a cherry picker. For example, the wheeled stand could be moved to a position immediately proximate a seated patient to help transfer them from a wheelchair to a toilet or bed or vice-versa.

Figure 3A:
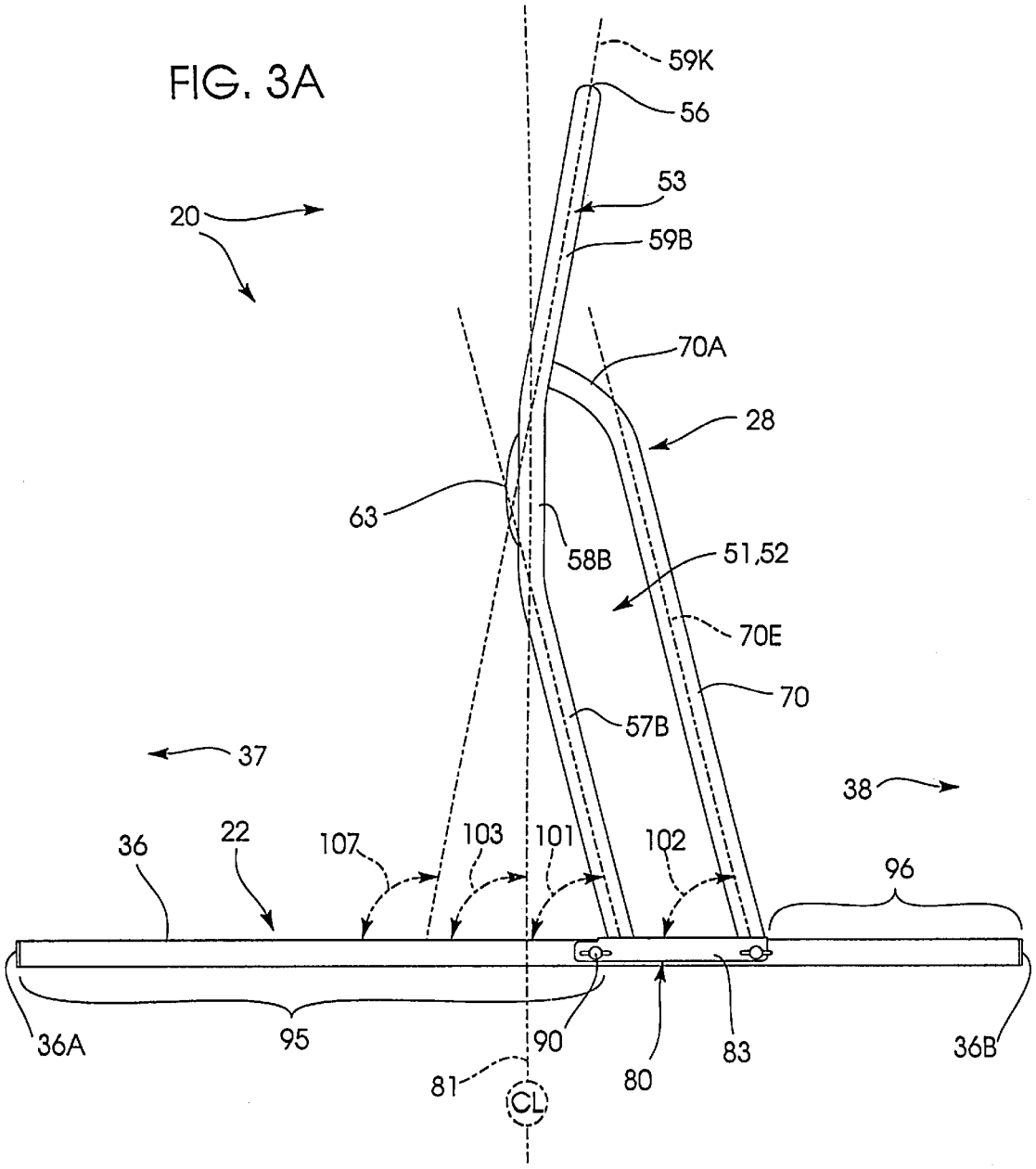
FIG. 3A is a diagrammatic side elevational view similar to FIG. 3, but showing angular relationships between the various parts that are believed important in the best mode.

With primary attention now directed to FIG. 3A, in the best mode certain angular and spatial relationships are observed. For example, the center of the base 22 has been genuinely designated by the reference numeral 81. It can be seen that the tower 28 is mounted slightly to the right (as viewed in FIG. 3A) such that mounting bracket 80 is shifted away from center line 81. Distance 95 between rail front 36A bracket 80 significantly exceeds the distance 96 between rail rear 36B and bracket 80.

Preferably the tower bottom portions 57B and 57A extend upwardly from the base at an acute angle 101 of approximately 70 to 80 degrees. Angle 101 is substantially equal to angle 102 formed between the center line of reinforcements 70, 71. Thus reinforcements 70, 71 are substantially parallel to tower lower base portions 57B & 57A respectively. However, the intermediate frame side portions 58A, 58B are oriented substantially perpendicular to the base. Thus in the best mode angle 103 is approximately 90 degrees. Finally, the uppermost side portions of the tower frame 59A & 59B have a center line 59K that forms an obtuse angle 107 with the base (FIG. 3A). In the best mode angle 107 is approximately 100 degrees. The handle 56 thus is oriented above and to the rear of the knee support 62 (FIG. 4).

Figure 5:
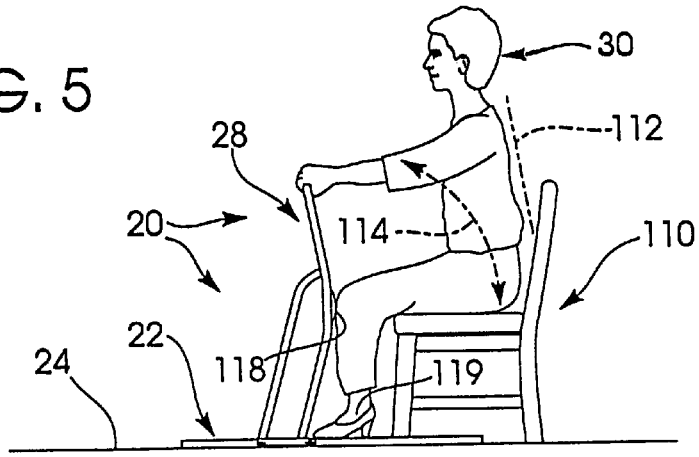
FIG. 5 is a partially fragmentary, pictorial view, showing a seated user who is about to rise.
Figure 6:
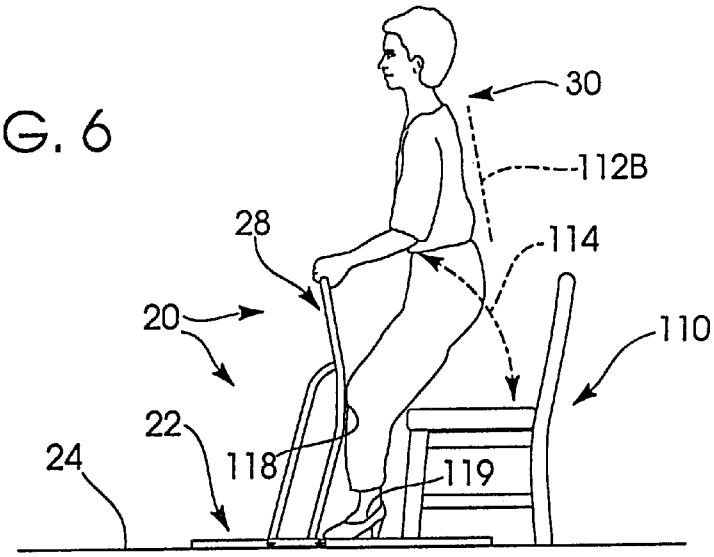
FIG. 6 is a view similar to FIG. 5 but showing a user partially standing.
Figure 7:
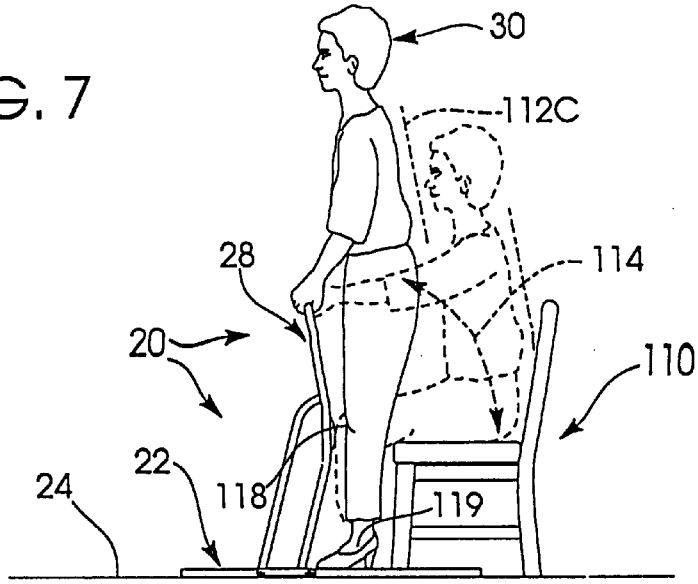
FIG. 7 is a view similar to FIGS. 5 and 6 but showing a standing user.

With additional reference to FIGS. 5–7, a user 30 may be comfortably seated within a conventional chair 110. At this time the back of the user 30 is aligned as indicated in dashed lines 112. While rising, the hips of the user will ideally be displaced in an arc 114. In the best mode, the pulling forces that must be exerted by the user 30 (FIGS. 5–7) to rise will be reduced substantially if the user first moves their chin towards their thumbs (i.e., the users hands will be grasping the tower or handle at this time.)

As apparent from FIG. 5 the chair 110 is received within the clearance area 43 (FIG. 4) between the base rails at the front 37 of the stand. To use the apparatus the stand is grasped and pulled into position with its front facing the user, and with the front rails clearing opposite sides of the chair 110. The back of the user will be oriented parallel with line 112.

When the user 30 pulls upwardly with their arms, their knees 118 may firmly abut the knee guard. At this time the users feet 119 may be supported upon the antiskid surfaces provided on the foot plates 40. FIG. 6 illustrates that the orientation of the users back after rising. Line 112B is substantially parallel with line 112 of FIG. 5. When the user 30 has risen, line 112C will be substantially parallel to lines 112 or 112B. We have found that by providing the combination of the offset handle and the knee support as shown, ease of rising is substantially enhanced. Similarly the arc of travel 114 illustrated in FIGS. 5–7 is desirable to minimize discomfort.

Figure 8:
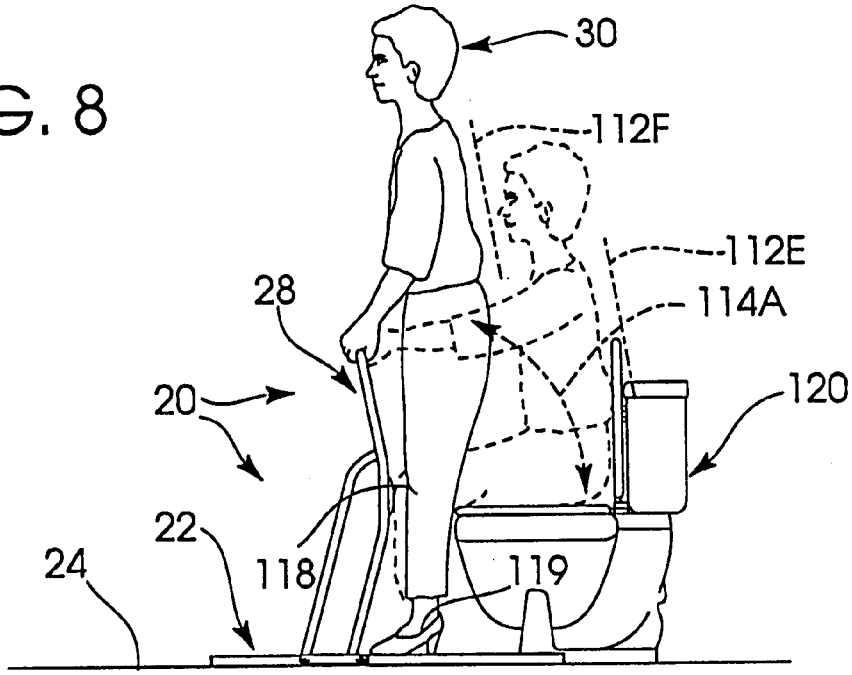
FIG. 8 is a view of a user rising from a commode.

Turning now to FIG. 8, it will be apparent that the stand 20 is of equal utility when the user 30 attempts to rise from a commode 120. In this instance the arc 114A is similar to arc 114 previously discussed for operator ease. As before, the position of the back is indicated by lines 112E & 112F. The stand may also be used with utility in conjunction with beds, sofas, love seats, benches and the like.

Figure 9:
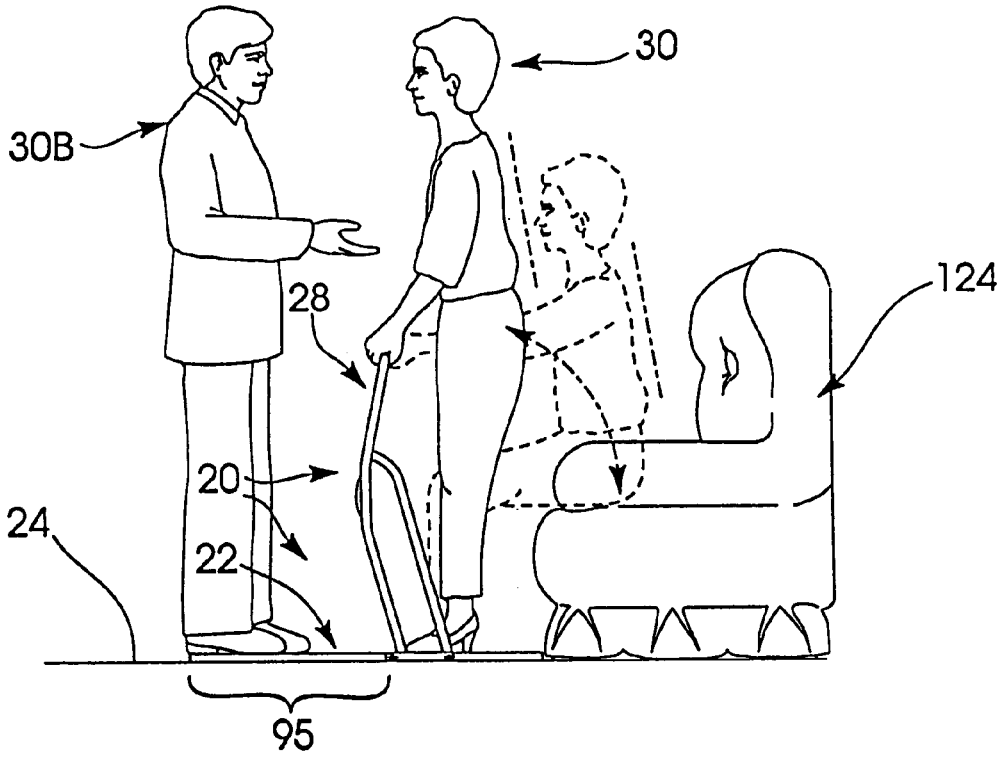
FIG. 9 is a pictorial view showing a user rising from an overstuffed chair, using the stand in a reversed position.

With reference to FIG. 9, the stand may be reversed when necessary. For example when a user 30 is seated within an overstuffed chair 124 he or she is shifted away from the handle of the stand. Further, the base of the chair 124 contacts the floor and obstructs access. By reversing the stand the shorter length 96 (FIG. 38) of the base rails allows the stand to be drawn closer. Further when the stand is reversed the handle tilts towards the user. An assistant 30B may stand on the opposite length 95 of the base to brace the stand 20. By standing on the opposite edge of the base, assistant 30B can stabilize the base and the stand 20 and thus help the user 30 in rising from difficult positions (FIG. 9).

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A stand for a handicapped individual, medical patient or other user that aids in assuming a standing position, said stand comprising;

a rigid, generally planar base having front and rear ends and comprising first and second rigid elongated spaced-apart rails extending generally between said front and rear ends, said base adapted to be generally horizontally disposed upon a supporting surface:

a rigid tower secured to and projecting generally vertically upwardly from said base and comprising:

a pair of spaced apart sides; and a handle extending horizontally between and secured to said sides and adapted to be grasped by a user when rising from a seated to a standing position; and a knee support secured to and extending between said sides for contacting the knees of the user seeking to rise when the handle is pulled by the user.

2. The stand of claim 1 further comprising a foot guard secured to and extending between said sides, above said rails and beneath said knee support, for limiting movement of the user's feet.

3. The stand of claim 1 wherein said base further comprises:

a plurality of spaced-apart, generally rectangular foot plates secured to and extending transversely between said rails, at locations spaced inwardly from said front and rear ends, for supporting one or more feet of the user.

4. The stand of claim 3 further comprising an elongated bracket that mates with and extends longitudinally along said rails for removably securing said tower to said base.

5. The stand of claim 3 further comprising first and second rigid reinforcements extending generally upwardly from said first and second rails, respectively, and terminating in arcuate portions joined to the tower, the arcuate portions adapted to be grasped by a user when the stand is reversed in position.

6. The stand of claim 5 wherein the sides of the tower are angled relative to vertical to ordinarily project the knee support towards the user and to project the handle slightly rearwardly away from the knee support and the user.

7. The stand of claim 5 wherein a void area is defined at the front end of the base between said rails, thereby providing clearance to permit the rails to be slid along opposite sides of the user of the stand.

8. The stand of claim 5 further comprising an anti-skid surface on said knee support that aids the user in rising.

9. The stand of claim 5 further comprising an anti-skid surface on at least one foot plate that aids the user in rising.

10. The stand of claim 3 wherein the tower is mounted off longitudinal center with respect to said base so that said rails are longer towards the front end of the base than at the rear end, whereby the stand when reversed modifies rail clearance.

11. A stand for helping a handicapped or other person of limited mobility to rise to a standing position, said stand comprising;

a front adapted to face toward said person and a rear adapted to face away from said person;

a rigid, generally planar base adapted to be disposed and rest flush directly upon a supporting surface, the base extending from said front to said rear;

a rigid tower adapted to be grasped by said person, said tower projecting generally vertically upwardly from said base and comprising:

a generally rectangular frame having a pair of spaced apart, generally parallel sides and an integral handle extending substantially horizontally between the sides at a top of the tower, each frame side comprising: a bottom portion rigidly connected to said base at a connection location intermediate said front and rear and extending upward from the base at a forwardly facing acute angle of approximately seventy to eighty degrees; an integral intermediate portion bent slightly rearward from said bottom portion so as to be oriented substantially perpendicularly to said base; and an integral top portion extending upward between a respective intermediate portion and said handle, and bent slightly rearward from said intermediate portion to form a forwardly facing obtuse angle with respect to said base, each top portion terminating in a respective end of said handle.

12. The stand of claim 11 further comprising a knee support extending in a vertical plane between said frame side intermediate portions for contacting the knees of said person seated at the front of said stand, and a foot guard extending between said sides below said knee support for limiting movement of the person's feet.

13. The stand of claim 12 wherein said base comprises:

a pair of rigid, elongated spaced-apart rails extending generally between said front and said rear; and a plurality of spaced-apart, generally rectangular horizontal foot plates extending transversely between said rails for supporting one or more feet of said person, at least a first of said foot plates located forwardly of said connection location, and at least a second of said foot plates located rearwardly of said connection location.

14. The stand of claim 13 further comprising a horizontally elongated bracket for removably mounting said tower to said base.

15. The stand of claim 13 further comprising a pair of rigid reinforcements extending generally upwardly and forwardly from said base that terminate in arcuate portions joined to respective frame sides of the tower, the arcuate portions adapted to be grasped by said person when the stand is reversed in position front to rear relative to said person.

16. A portable stand for helping a person of limited mobility, such as a handicapped individuals, medical patient or the like to rise to a standing position, said stand comprising;

a front adapted to face said person and a rear adapted to face away from said person;

rigid, generally planar base adapted to be dispose upon a supporting surface, the base comprising a pair of spaced-apart, parallel rails extending generally between said front and said rear, and a plurality of spaced-apart foot plates extending transversely between said rails for supporting one or more feet of said person, whereon said base is open-ended at said front of said stand to permit said rails to be moved forwardly along said supporting surface to position said rails along respective opposite sides of said person in a seated position;

a generally vertical tower removably coupled to said base, said tower comprising:

a generally rectangular frame having a pair of spaced apart, generally parallel sides, each frame side comprising a bottom portion connected to said base and forming an acute angle therewith, an integral, intermediate portion oriented substantially perpendicularly to said base, and integral top portions that form an obtuse angle with respect to said base;

an integral handle adapted to be grasped by said person;

a knee support extending between said frame side intermediate portions that may be contacted by the knees of said person's feet; and a foot guard for limiting movement of the person's feet.

17. The stand of claim 16 further comprising wheels adapted to be attached to the base to transform the stand to a walker.

18. The stand of claim 16 further comprising a pair of rigid reinforcements extending generally upwardly from said base that terminate in arcuate portions joined to the tower, the arcuate portions adapted to be grasped by a user when the stand is reversed in position.

19. The stand of claim 18 further comprising an anti-skid surface on said knee support and on at least one foot plate.

20. The stand of claim 19 wherein said foot guard extends between said sides below said knee support for limiting movement of the person's feet.

* * * * *